US007147120B2

(12) United States Patent
Rosenberg et al.

(10) Patent No.: US 7,147,120 B2
(45) Date of Patent: Dec. 12, 2006

(54) DRAWER ORGANIZER

(76) Inventors: Gayle Rosenberg, 1332 Harmon Cove Towers, Secaucus, NJ (US) 07094; Eli Pine, 827 Harmon Cove Towers, Secaucus, NJ (US) 07094

( * ) Notice: Subject to any disclaimer, the term of this patent is extended or adjusted under 35 U.S.C. 154(b) by 0 days.

(21) Appl. No.: 11/340,468

(22) Filed: Jan. 27, 2006

(65) Prior Publication Data

US 2006/0124647 A1 Jun. 15, 2006

Related U.S. Application Data

(63) Continuation-in-part of application No. 10/669,406, filed on Sep. 25, 2003, now abandoned.

(60) Provisional application No. 60/474,889, filed on Jun. 3, 2003.

(51) Int. Cl.
*B65D 6/26* (2006.01)

(52) U.S. Cl. ..... 220/8

(58) Field of Classification Search ..... None
See application file for complete search history.

(56) References Cited

U.S. PATENT DOCUMENTS 5,016,772 A * 5/1991 Wilk ..... 220/8
5,680,949 A * 10/1997 Roesler ..... 220/8
6,129,433 A * 10/2000 Rosenberg et al. ..... 312/348.3

* cited by examiner

*Primary Examiner*—Stephen Castellano
(74) *Attorney, Agent, or Firm*—Arnold D. Litt; Herten, Burstein, Sheridan, Cevasco, Bottinelli, Litt & Harz LLC.

(57) ABSTRACT

An organizer for a drawer or other rectangular or non-rectangular space. The organizer has a plurality of individual elements that are mutually nested together and can be moved both in the width direction and in the length direction to expand or contract the organizer so as to conform to the dimensions of the drawer or other rectangular or non-rectangular space. Each element has a bottom surface that combines to provide a contiguous bottom surface of the organizer in the expanded and contracted positions. There is also a peripheral continuous raised edge that surrounds the perimeter of the organizer when in the contracted or expanded positions.

9 Claims, 12 Drawing Sheets

DRAWER ORGANIZER

CROSS REFERNCE TO RELATED APPLICATIONS

This application is a continuation-in-part of U.S. patent application Ser. No. 10/669,406, filed Sep. 25, 2003, entitled "X-Y-Z DRAWER ORGANIZER", now abandoned, which claims the benefit of U.S. Provisional Application Ser. No. 60/474,889, filed Jun. 3, 2003, entitled "XYZ DRAWER ORGANIZER".

BACKGROUND OF THE INVENTION

1. Field of Invention

The present invention relates to an adjustable organizer for filling a rectangular or non-rectangular space and, more particular, to an adjustable drawer organizer that can be adjusted in two planar directions, that is, the X and Y directions.

2. Description of Related Art

There are many different types of organizers that are used in rectangular areas or enclosures, particularly drawers, and which serve to provide some semblance of order to the various contents placed within that area or enclosure.

Organizers are basically used in rectangular, confined spaces and such organizers are, therefore, adapted to fit into a space having opposite parallel sides. For purposes of the present invention, the rectangular spaces will be defined as having a width direction and a length direction, and those directions are measured between the opposite parallel sides since the intended site is as described a rectangular space.

The actual direction or orientation of the length and width directions is not critical since the rectangular shape can, of course, be a square, and therefore the length and width directions can be applicable to any rectangular space, it only being of importance that the two directions be orthogonal to each other with respect to the rectangular space. These directions can also be defined as the X and Y directions and are measured along a normally planar surface.

With that background, it is known to have organizers having adjustable dimensions so as to fit within a particular space, such as a drawer. Since it would not be practical to make commercially available an organizer specifically dimensioned to fit within all of the various sized drawers or other rectangular spaces, the ability to alter the dimensions of the organizer is a desirable feature and allows the commercially sold organizer to be adjusted by the purchaser to fit into the various sizes of drawers or other rectangular spaces.

At the present, expandable/contractible features allow organizers to be expanded or contracted by the user along a dimension, be it the width or the length of the organizer, in order to fit the organizer snugly into the particular dimensioned drawer and not, therefore, slide within the drawer.

Accordingly with currently available organizers, however, the difficulty is that they can expand or contract along only one dimension, that is, along either the width dimension or the length dimension but not both. While versatile to a degree, it would be advantageous to have an organizer that could be changed dimensionally in both directions or along the length and width directions while still maintaining a bottom surface that is contiguous such that the bottom surface still covers the entire rectangular surface on which the organizer is utilized.

As a further advantageous feature, it would be desirable to have an organizer that is not only adjustable along two directions, but also to have a continuous peripheral upraised exterior edge such that objects contained within the organizer are retained therein whether the organizer is located in a drawer or other rectangular surface.

As a still further feature, it would be desirable to have an organizer that can be expanded and contracted along two directions.

SUMMARY OF THE INVENTION

Accordingly, the present invention relates to the organizer that can be used within a rectangular or non-rectangular space, preferably a drawer, and where the organizer can be dimensionally adjusted in both the width direction and the length direction in order to comfortably and securely fit within and conform to that space. As such, one organizer can be commercially available, which can readily be adjusted to fit within, for example, a drawer so as to conform to both the length and width of that drawer while still maintaining a contiguous bottom of the organizer that lays flat atop of the planar surface of the drawer.

As will be seen, the present invention is generally described and referred to in its preferred mode, that of a drawer organizer, however, it is equally useful for other rectangular spaces where some organization or compartmentalizing of the objects within that rectangular spade is desired.

With the present invention, therefore, there are a plurality of individual elements that are sized and shaped so as to cooperatively work together to allow the organizer to be adjustable along both the width dimension as well as the length dimension so as to fit fully along all of the four side edges against the inside wall of a drawer or other rectangular space.

In accordance with a preferred embodiment there is a first element that has a bottom surface having dividers that extend upwardly from the bottom surface so as to form the compartments or sections in which the objects are placed in order to keep order and separation of those objects. The first element has a bottom surface and preferably an upraised peripheral exterior edge defining a fixed area there within to retain the objects within the first element. A portion of the dividers are attached to at least a portion of the peripheral edge and a portion of the dividers are attached to each other, so as to form a plurality of spaces within the fixed area. The dividers are in substantially fixed position relative to each other and relative to the peripheral edge.

There are also one or more second elements, that is, there may be a single second element or a pair of second elements. In either embodiment, the second element(s) have a bottom surface that underlies the bottom surface of the first element and is slidingly engaged therewith so as to move in the length direction of the drawer or other rectangular space. In a preferred embodiment, the second element or elements have three sides having raised, peripheral exterior edges, the sides that do not underlie the bottom surface of the first element and a flat edge that does underlie the bottom surface.

There is also a third element that is slidingly nested with the first element and the second element. The third element can be moved in the width direction of the drawer or rectangular space. The third element has a bottom surface and preferably two edges that are formed as raised exterior edges and two flat edges that underlie the bottom surface of the first and second elements. Preferably, the second and third elements may be moved substantially simultaneously to reduce or enlarge the width and length of the organizer.

Finally, there is a fourth element that is movable in the width direction and has a bottom surface that underlies and slidably nests with the bottom surface of the first element and preferably has two raised outer edges and two flat edges. The fourth element is in substantially mirror image relationship to the third element. It is adapted to underlie or overlie and slidably nest with the third element. The third and fourth elements are both also movable with respect to each other in the length direction. Preferably the third and fourth elements may be moved substantially simultaneously to reduce or enlarge the width and length of the organizer. Accordingly, and in accordance with a preferred embodiment of the present invention, all of the bottom surfaces of the first through fourth elements form a contiguous bottom surface of the organizer laying atop of the drawer surface or other rectangular space and the overall organizer can be dimensionally adjusted in the length and the width directions while still retaining the contiguous bottom surface made up of the various combined bottom surfaces of the individual elements. The various raised exterior edges of the elements combine to form a continuous raised exterior edge of the organizer despite the desired changes to the length and/or width dimensions of the organizer.

As another feature of the present organizer, there is a system of guide slots and guide ribs that interengage so the respective raised exterior edges that are joined together can be joined by a releasable mechanism such that the user can adjust the dimensional relationship between the elements and yet the elements are then held in a fixed, but releasable engagement within the drawer. The user can thereby release that engagement easily to re-dimension the organizer. However, the organizer will not, on its own, inadvertently, change its dimensions within the drawer. There may be serrated raised exterior edges used on some of the elements to bring about that releasable engagement.

These and other features and advantages of the present invention will become more readily apparent during the following detailed description taken in conjunction with the drawings herein.

DETAILED DESCRIPTION OF THE INVENTION

Figure 1:
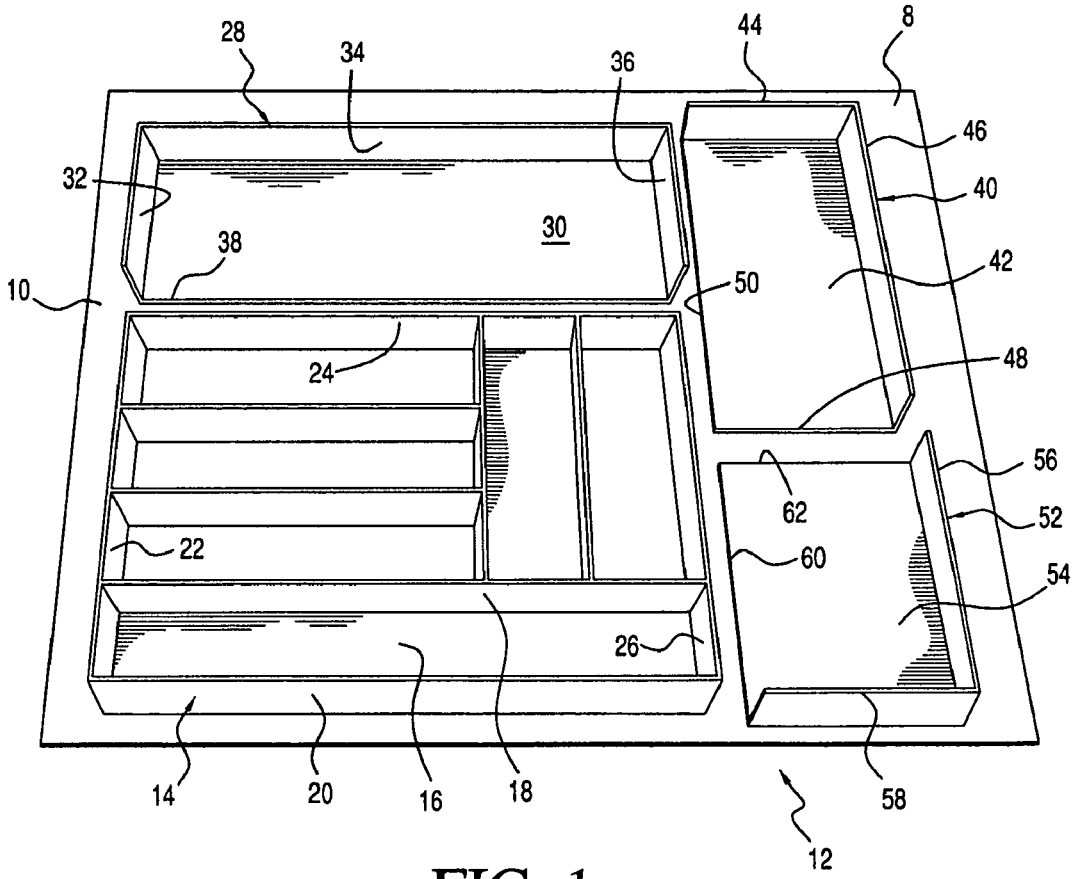
FIG. 1 is a top perspective view of an organizer constructed in accordance with the present invention showing the individual elements separated from each other.

Referring now to FIG. 1, there is shown a perspective view of the present invention and showing a rectangular surface 8 which is preferably the lower surface of a drawer but, as stated, may be one of a variety of other rectangular spaces where some semblance of organization or compartmentalization is desired for the objects to be placed in that drawer or other rectangular space.

As can be seen, the rectangular surface 8 has a generally planar surface 10. It also has a length dimension L and a width dimension W. As such, movement along that width dimension will be referred to as movement in the width direction and movement along the length dimension will be referred to as movement in the length direction.

Thus, in FIG. 1, there can be seen an organizer 12 that comprises a first element 14 having a bottom surface 16. The organizer 12 further includes a plurality of upwardly raised fixed dividers 18 that are used to separate the objects placed on the bottom surface 16 of the first element 14 in organizing the contents of, for example, a drawer. Obviously, the number and location of any of the raised dividers 18 is a matter of design choice depending upon the characteristics of the objects to be placed thereon and may, therefore, form any variety of subdivided spaces or areas on the bottom surface 16.

As also can be seen, the first element 14 preferably has outer peripheral raised edges including two raised exterior edges 20, 22 and two raised interior edges 24, 26. As such, the combination of raised, exterior edges 20, 22 and raised interior edges 24, 26 complete the continuous peripheral edge surrounding the perimeter of the first element 14. The height of the raised edges may vary depending upon the objects to be placed in the first element 14 but can be about the same height or slightly higher than the raised dividers 18.

There is also a second element 28 shown in FIG. 1. The second element 28 also has a bottom surface 30 and three raised edges, that is, raised edges seen as exterior edge 32, exterior edge 34 and interior edge 36. The fourth edge is a flat edge 38 that is in the plane of the bottom surface 30 and, as can be seen, is adapted to be slidingly nested with the first element 14 by positioning the flat edge 38 underneath the interior edge 24 and the bottom surface 16 of the first element 14. Thus, the second element 28 can be moved toward and away from the first element 14 in the length direction to vary the overall length of the organizer 12 in order to fit within the particular length of a drawer or other rectangular space where the organizer 12 is being used.

As is also clear, the bottom surface 16 of the first element 14 and the bottom surface 30 of the second element 28 are contiguous. That is, the combined bottom surfaces 30, 28 form a common bottom surface of the organizer 12 to fully cover the rectangular surface 10. Thus, even though the second element 28 can be moved in the length direction with respect to the first element 14 to alter the length dimension of the organizer 12, the bottom of the organizer 12 remains intact by the combined bottom surfaces 30, 16.

A third element 40 is also provided having a bottom surface 42 and having two raised edges, that is, exterior edges 44, 46 and two flat edges, shown as flat edges 48, 50. The flat edges 48, 50, as can be seen, are adapted to underlie the first element 14 and the second element 28 so as to be movable in the width direction to alter the width dimension of the organizer 12. Again, the bottom surface 42 of the third element 40 thereby cooperates and nests with the bottom surfaces 16, 30, respectively, of the first and second elements 14, 28 to maintain a complete and contiguous bottom surface of the organizer 12.

Finally, and in accordance with a preferred embodiment described herein, there is a fourth element 52 having a bottom surface 54 and having raised exterior edges 56, 58 and flat edges 60, 62. As such, the flat edge 60 is adapted to underlie and nest with the first element 14 so as to form a combined and contiguous bottom surface by the combined bottom surface 16 of the first element 14 and the bottom surface 54 of the fourth element 52.

The flat edge 62 of the fourth element 52 also nests with the flat surface 50 of the third element 40 and may overlie or underlie in that nesting relationship. In any event, the fourth element 52 is movable in the width direction to vary the width dimension of the organizer 12 and that width movement is undertaken in cooperation with the third element 40 to coordinate the movement such that both the third element 40 and the fourth element 52 act together when moving in the width direction to make sure the raised exterior edges 46, 56 are together and form a straight, raised exterior edge of the organizer 12.

Additionally, the third element 40 and the fourth element 52 can move in the length direction with respect to each other so as to remain aligned with the first and second elements 14, 28 when those elements are moved to vary the length dimension. As can now be seen, by moving the various elements in the width direction and the length direction, the overall dimensions of the organizer 12 can be changed to suit and conform to the dimensions of the particular drawer or rectangular space. As such, the first, second, third and fourth elements 14, 28, 40 and 52 can be individually manipulated and yet the respective bottom surfaces 16, 30, 42 and 54 remain in a contiguous relationship to fully cover the upper surface 10 of the drawer 8 or rectangular space. As well, and as will later be further seen, the dimensional changes of the organizer 12 brought about by the movement of the aforementioned elements still results in a continuous outer raised edge of the organizer 12 by means of the combined raised outer edges 20, 22, 32, 34, 44, 46, 56 and 58.

Figure 2:
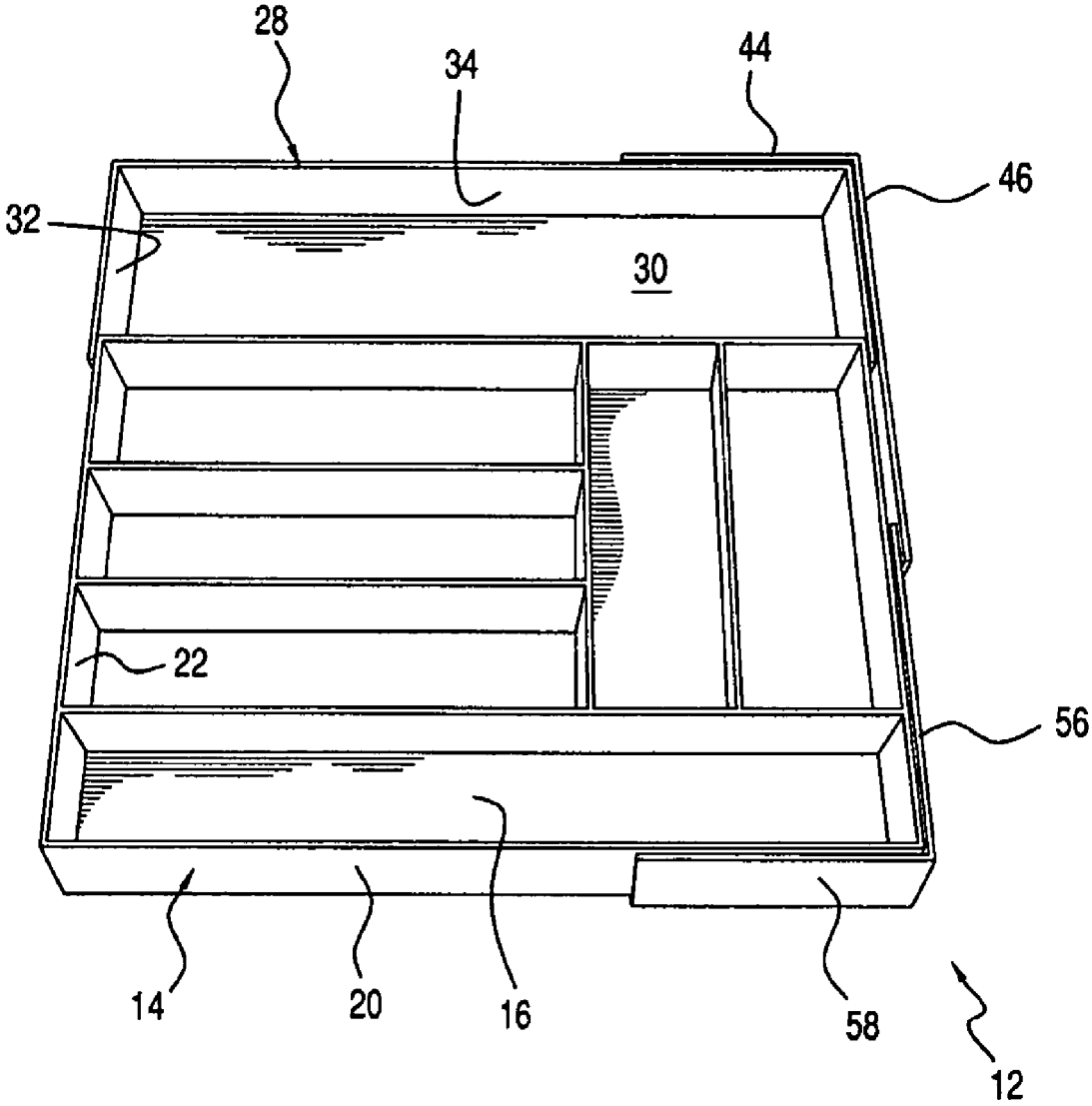
FIG. 2 is a top perspective view of the present organizer with one of the elements extended in the length direction.

Turning now to FIG. 2, there is shown a top perspective view of the organizer 12 with the third and fourth elements 40, 52 fully nested. As shown in this figure, the second element 28 has been moved to its extended position where the organizer 12 reaches the maximum length dimension since the second element 28 has been moved along the length direction to the position in FIG. 2. As can be seen, the bottom surface 30 of the second element 28 is still contiguous with the bottom surface 16 of the first element 14. The peripheral, raised exterior edge of the organizer 12 is continuous and is made up of the various raised exterior edges 20, 22 of the first element 14, the raised exterior edges 32, 34 of the second element 28, the raised exterior edges 44, 46 of the third element 40 and, finally, the raised exterior edges 56, 58 of the fourth element 52. It should be noted the raised exterior edges 44, 46 of the third element 40 and the raised external edges 56, 58 of the fourth element 52 are basically abutting against certain of the raised exterior edges 20, 26, 34, 36 of the first and second elements 16, 28 since the third and fourth elements 40, 52 are in the fully retracted positions and are not extended in the width direction.

Figure 3:
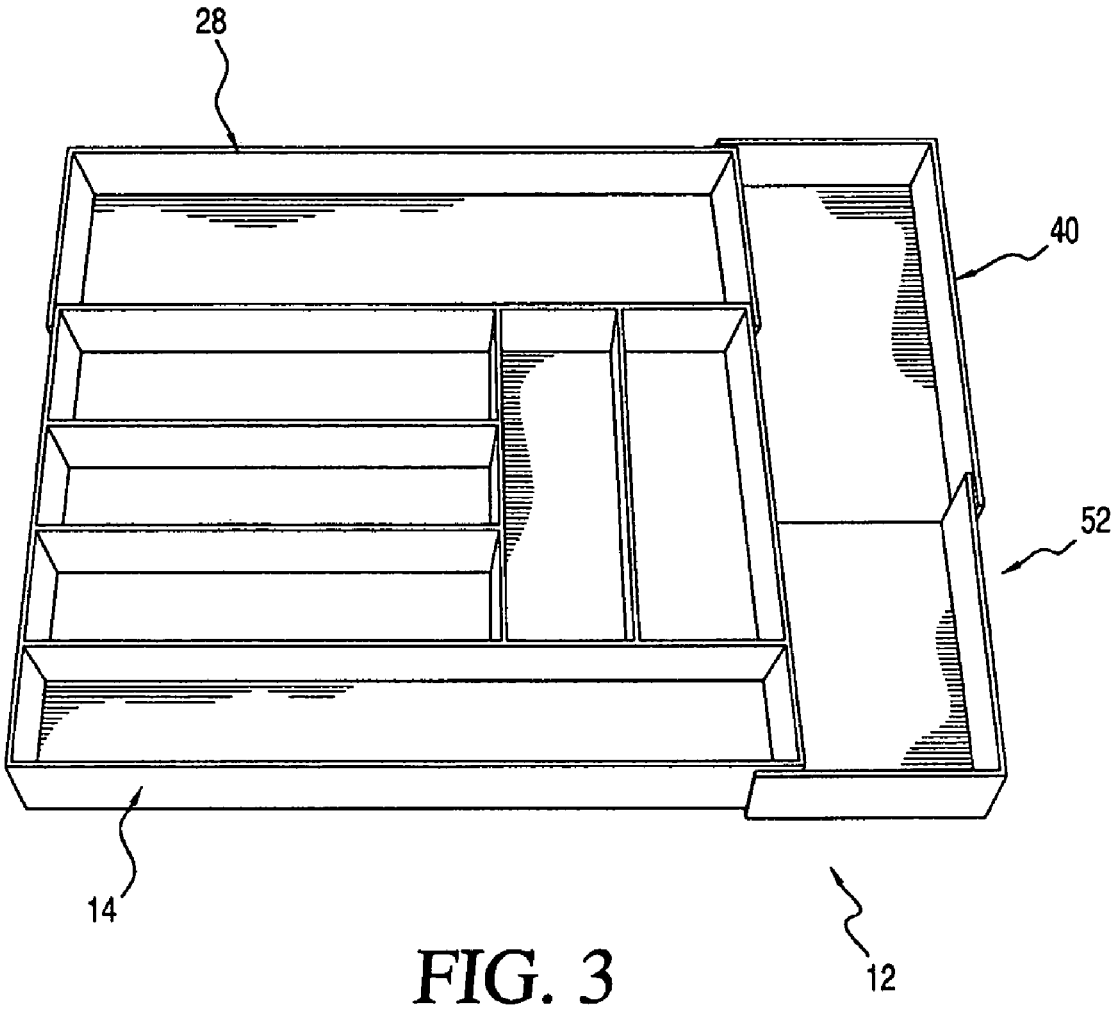
FIG. 3 is a top perspective view of the present organizer with two additional elements extended in the width direction.

Referring to FIG. 3, there is a top perspective view of the present organizer 12 in its fully extended position, that is, the second element 28 has been moved along the length direction to its extended position providing the maximum length dimension. In addition, the third and fourth elements 40, 52 have been moved in the width direction to their maximum extension and, therefore, the maximum width direction. The third and fourth elements 40, 52 have also been moved in the length direction with respect to each other to match the length of the combined first and second elements 14, 28 so that the overall outer perimeter of the organizer 12 is a rectangle still bounded by a continuous raised exterior edge and forming a contiguous bottom surface.

Figure 4:
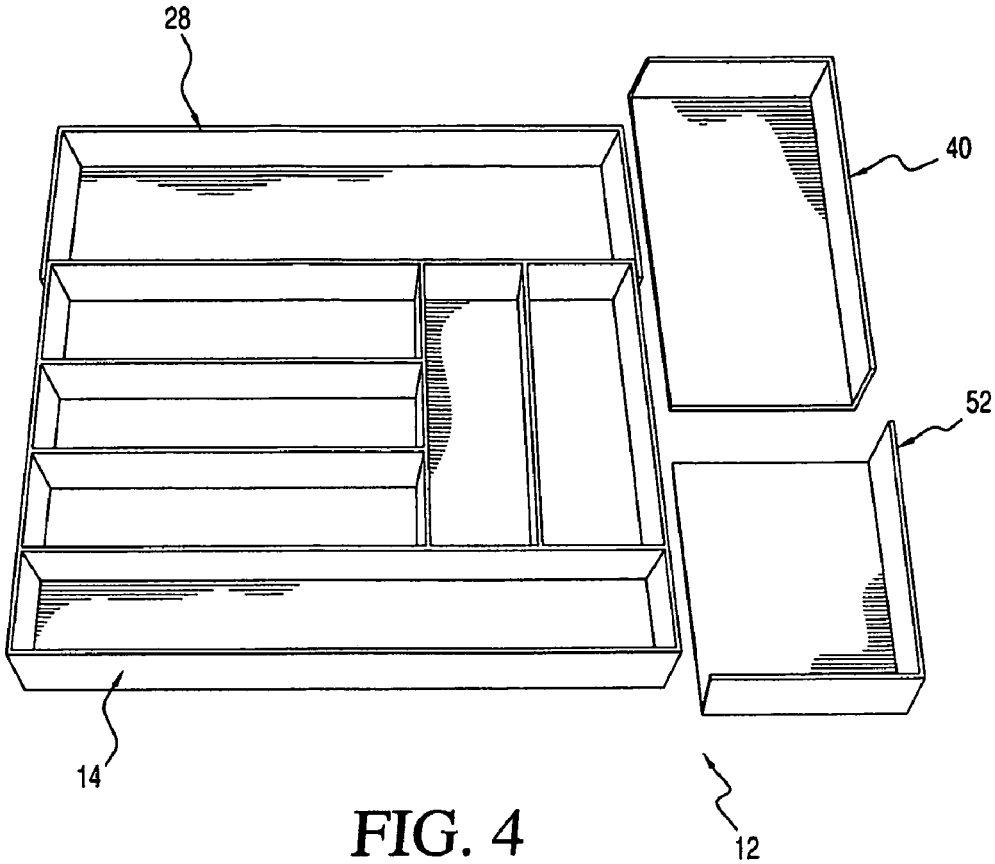
FIG. 4 is a top perspective view of the present organizer with one of the elements extended in the length direction and with the other two elements removed.

Turning now to FIG. 4 there is shown a top perspective view of the organizer 12 of the present invention and illustrating the third and fourth elements 40, 52 separated from the first and second elements 14, 28 for purposes of viewing the construction of the organizer 12. As such, and as shown in FIG. 4, the second element 28 is at its extended position providing the full length dimension of the organizer 12 and, as can be seen, the third and fourth elements 40, 52 are separated for illustrative purposes but would normally be nested with each other in an overlapping relationship so as to be movable in both the width direction together and moved relative to each other in the length direction.

Figure 5:
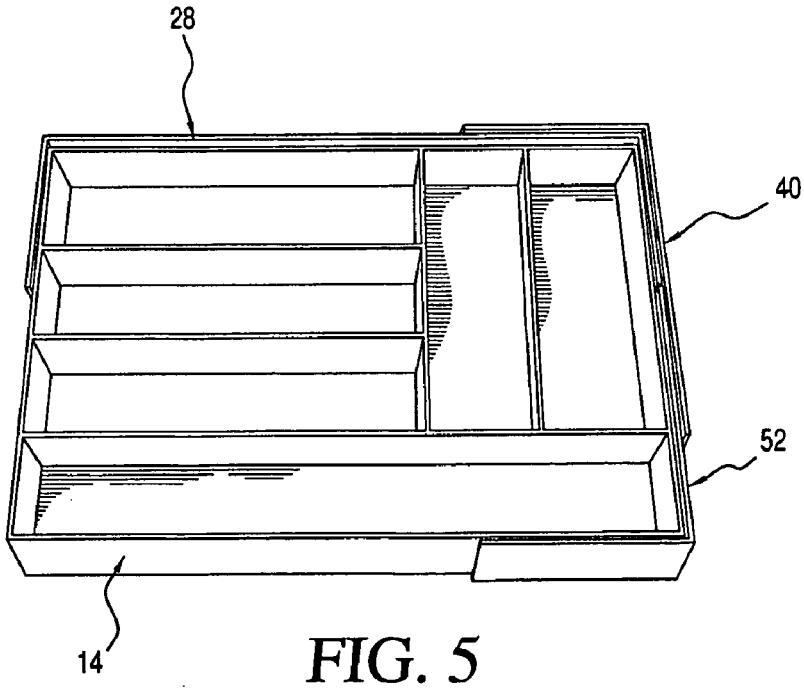
FIG. 5 is a top schematic view of the present organizer of the present invention with one of the elements partially moved in the length direction with the other two elements moved in both the length and width directions.

In FIG. 5, the organizer 12 is shown taking up the minimum area, since the second, third and fourth elements 28, 40, 52 are all in their fully retracted positions and thus the overall area of the organizer 12 is basically the area of the first element 14. Again the raised exterior edge is present surrounding the organizer 12.

Figure 6:
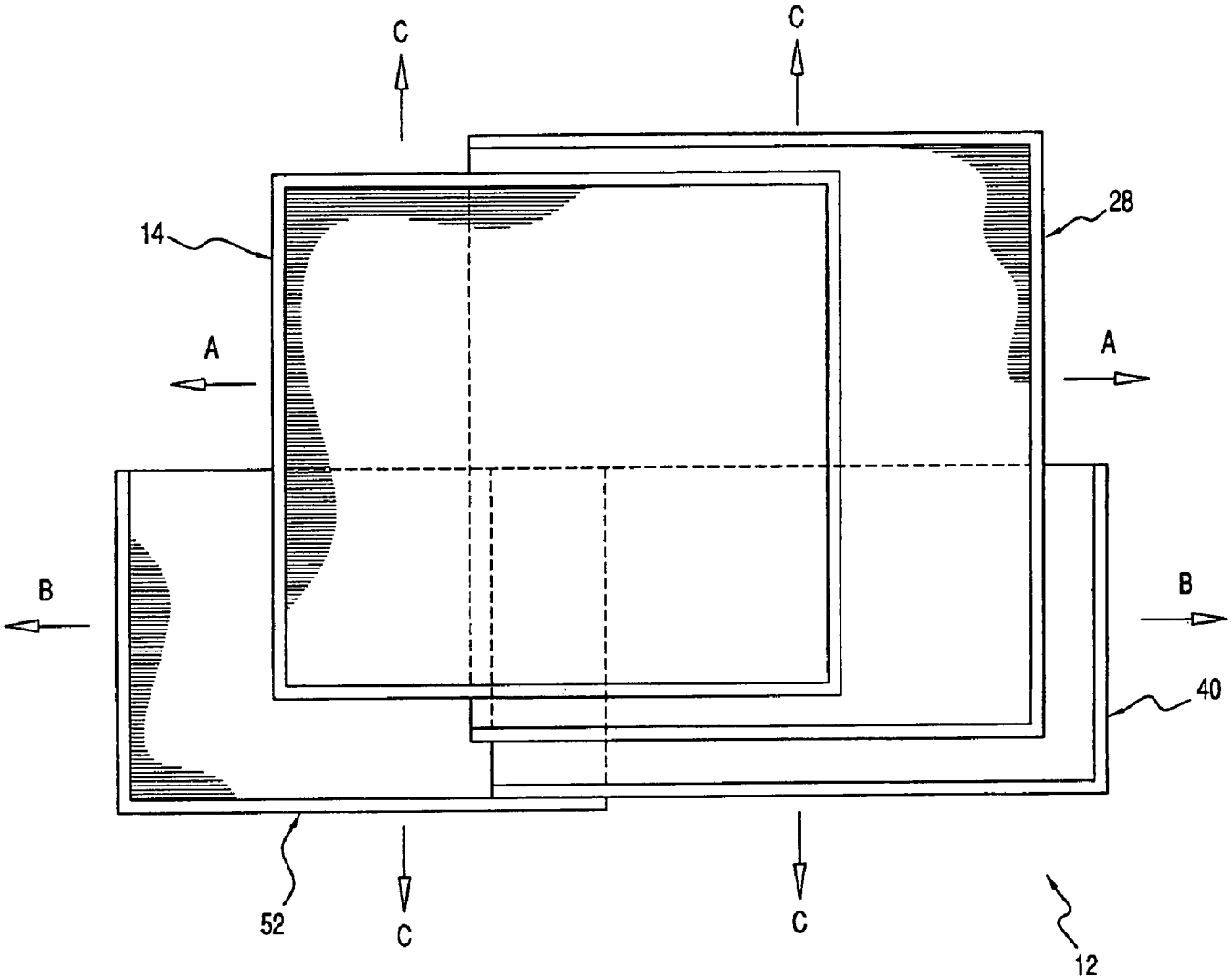
FIG. 6 is a top schematic view of an alternative embodiment of the present organizer with two elements moved in the length direction and two elements moved in both the length and width directions.

Turning now to FIG. 6, there is shown a top schematic view of the organizer 12 of the present invention and used to illustrate the directions of movement of the various elements 14, 28, 40, 52 of the organizer 12. As can be seen, therefore, the first and second elements 14, 28 can be moved in the length direction, shown by the arrows A to increase and decrease the length dimension of the organizer 12. Both of the third and fourth elements 40, 52 can be moved in the width direction with respect to the first and second elements 14, 28 as shown by the arrows B to increase and decrease the width dimension of the organizer 12. Lastly, the third and fourth elements 40, 52 can also be moved in the length direction, shown by the arrows C, so as to increase or decrease the length dimension of the combined third and fourth elements 40, 52 to match the length dimension of the first and second elements 14, 28 to make the overall organizer 12 a rectangular configuration.

Figure 7:
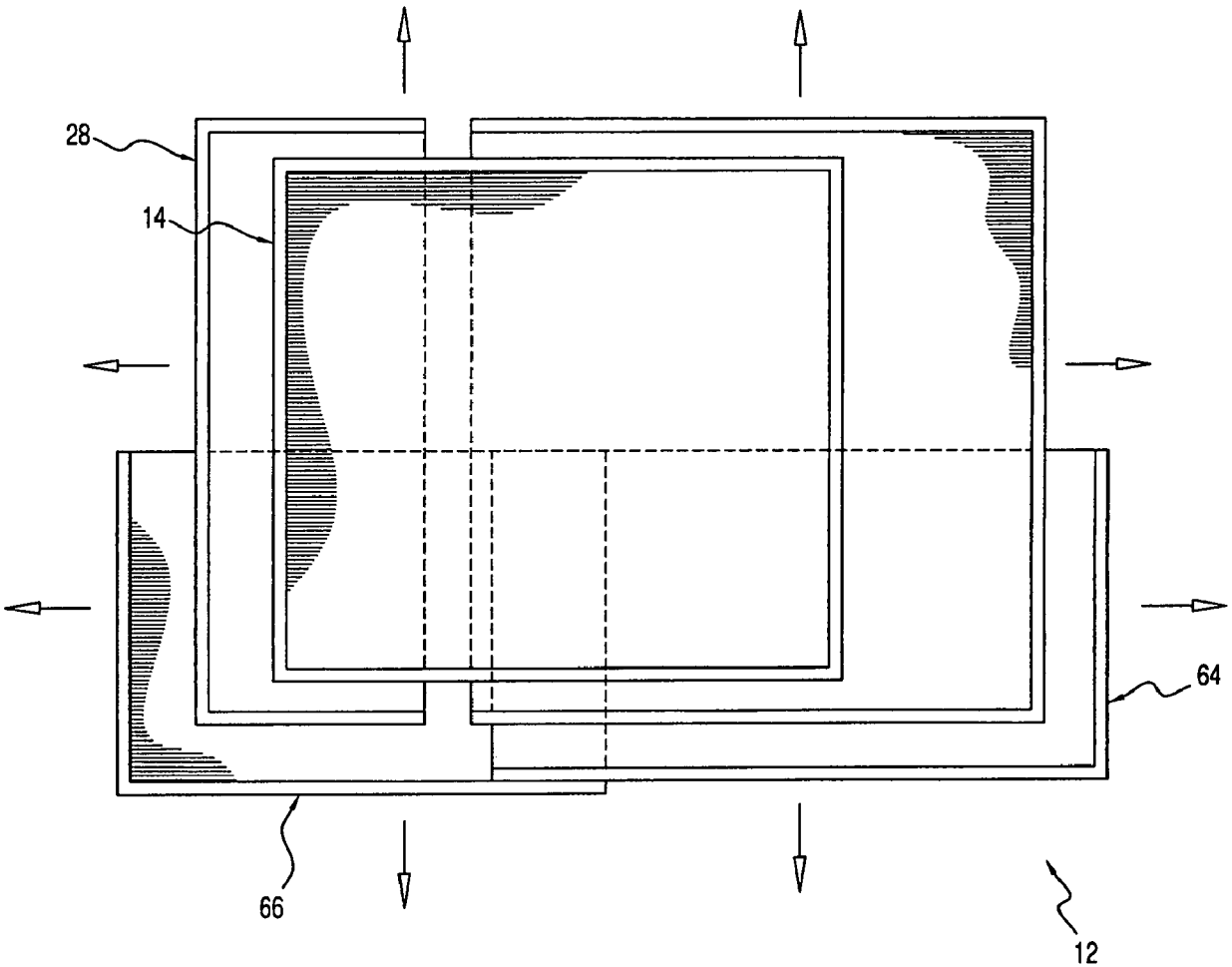
FIG. 7 is a top perspective view of the present organizer with the elements removed but with two of the elements nested together to illustrate the nesting arrangement.

Turning now to FIG. 7, there is shown a top schematic view of an alternative embodiment of the present invention (and similar reference numerals are used for elements similar to those disclosed with reference to the embodiment of FIGS. 1 to 6). In accordance with this embodiment, five elements are present instead of the four elements of the organizer 12 disclosed above with reference to FIGS. 1 through 6. In accordance with this embodiment, there is a first second element 64 and a second second element 66. Both of those elements are nested with the first element 14 and both of the first and second second elements 64, 66 move in the length direction in a similar manner to the second element 28 of FIGS. 1 through 6.

As such, and in accordance with this embodiment, instead of only one second element, as with the prior embodiment, there are two second elements 64, 66 that move in the length direction and, therefore, an additional element is utilized in carrying out the purposes of the present invention. The third and fourth elements 40, 52 operate in the same manner as with the prior embodiment and, again the area of the organizer 12 can be expanded or contracted in both the length direction and the width direction while maintaining a contiguous bottom surface and a peripheral raised exterior edge.

Figure 8:
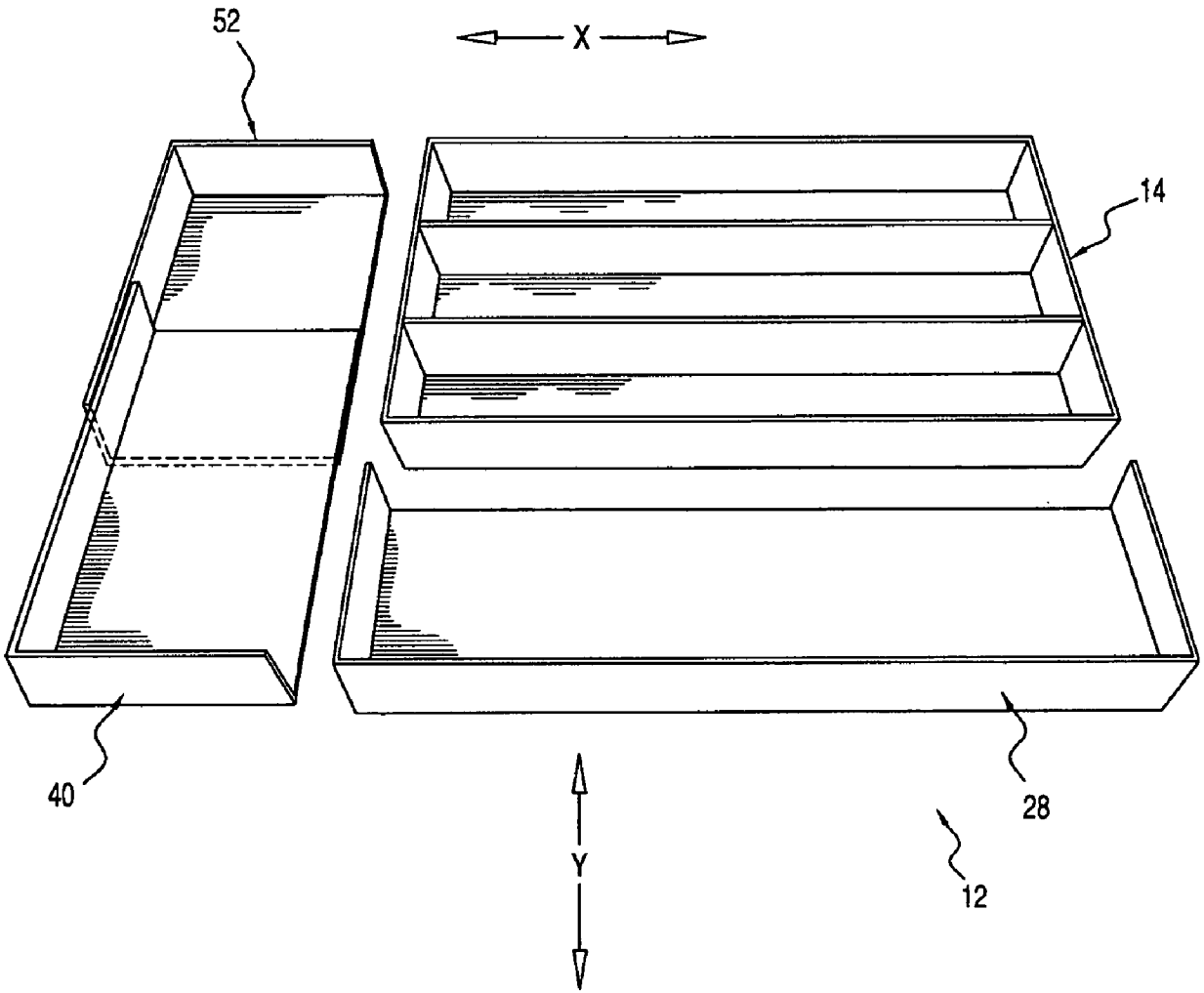
FIG. 8 is a top perspective view of the present organizer with the first and second elements separated, and also showing the third and fourth elements nested in their sliding relationship to each other.

Turning now to FIG. 8, there is shown a top perspective view of an organizer 12 of the present invention and showing the first and second elements 14, 28 separated and also showing the third and fourth elements 40, 52 nested in their sliding relationship to each other.

Figure 9A:
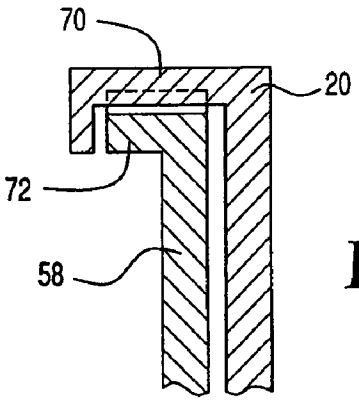
FIGS. 9*a* and 9*b* are respective views depicting the overlapping exterior edges provided with a releasable engagement system.
Figure 9B:
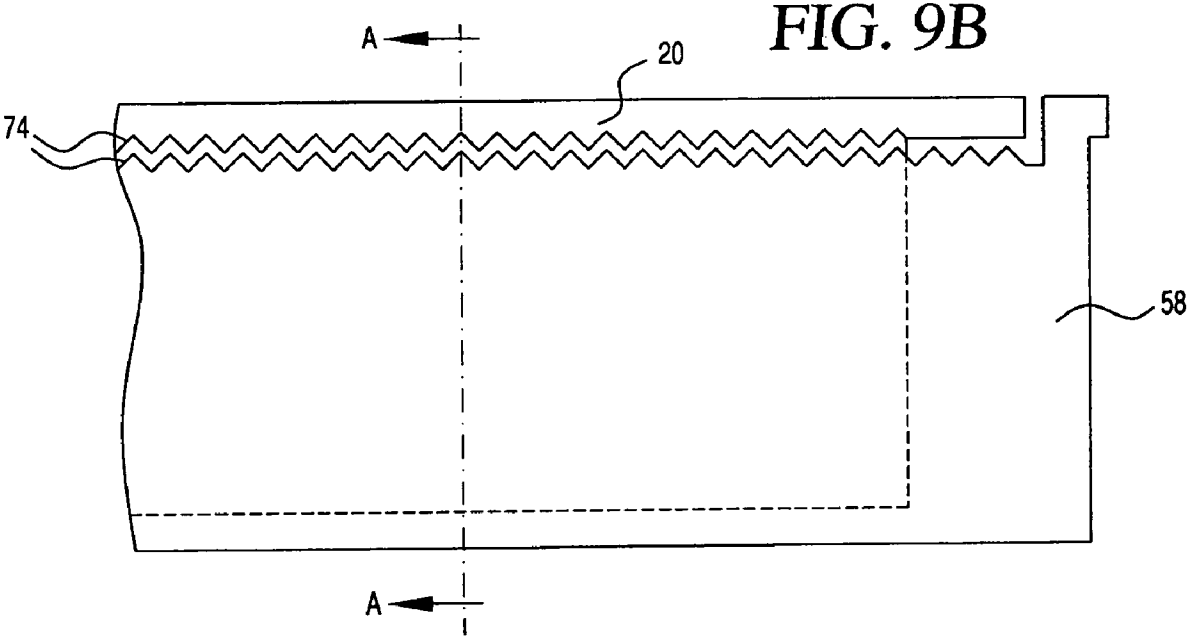

Referring to FIGS. 9*a* and 9*b*, and in accordance with a preferred embodiment of the present invention, overlapping exterior edges 20, 58 are shown provided with a releasable engagement system. The diagram includes a cross sectional view of the overlapping edges 20, 58. The releasable engagement system is generally composed of a guide slot 70 formed as a lip capping and perpendicular to a first raised exterior edge 20. The guide slot 70 is shaped and dimensioned to engage and capture a guide rib 72 formed as a lip capping and perpendicular to the adjacent second raised external edge 58 so that the two raised exterior edges 20, 58 slide together in an interlocking fashion with respect to each other. As illustrated in the cross sectional view, the guide slot 70 sits atop the guide rib 72 creating a "tongue and groove" arrangement similar to that disclosed in commonly owned U.S. Pat. No. 6,129,433, which is incorporated herein by reference. The weight of the guide slot 70 and associated first raised exterior edge 20 thereby rests on the guide rib 72 assisting in securing the overlapping exterior edges 20, 58 together. As those skilled in the art will certainly appreciate, the various elements linked in accordance with the present invention releasable engagement system are freely separable when removed from a drawer, but are coupled in a fixed relationship when placed within a drawer based upon the weight of the organizer forcing the various elements into engagement with each other.

The releasable engagement system is further provided with serrated teeth 74 along the guide slots 70 and guide ribs 72 of the raised exterior edge 20, 58. The serrated teeth 74 along the guide slots 70 are shaped and dimensioned to engage serrated teeth 74 formed on the guide ribs 72 of the adjacent raised external edges creating an interlocking arrangement. This interlocking arrangement selectively joins the respective raised edges 20, 58 in a releasable manner such that the user can adjust the dimensional relationship between the elements 14, 52. Therefore, the serrated teeth 74 are preferably uniform in shape so as to permit adjustment along the length of the overlapping exterior edges 20, 58. The elements 14, 52 are then held in a fixed, but releasable engagement due to the weight of the guide slot 70 in association with the first raised exterior edge 20 resting on the guide rib 72. The user can, therefore, release that engagement easily by lifting the first raised exterior edge 20 and repositioning it along the second raised exterior edge 58 to re-dimension the organizer. However, because the serrated edges 74 engage each other in a secure but releasable manner, the organizer will not, on its own, inadvertently, change its dimensions.

Figure 10A:
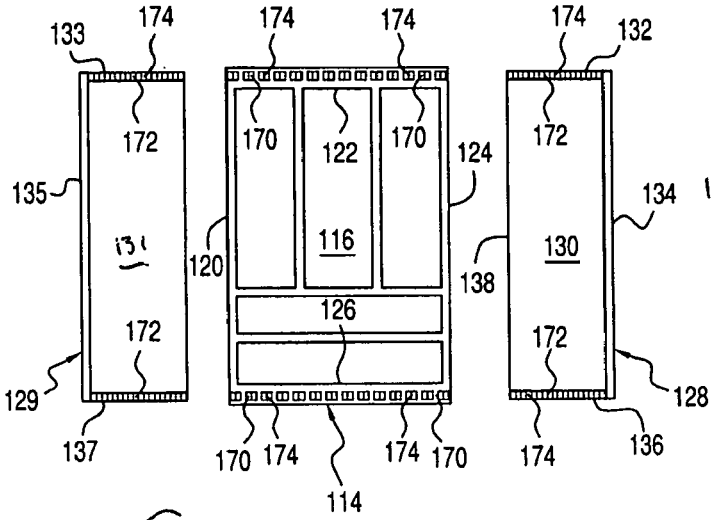
FIGS. 10*a*, 10*b*, 10*c*, 11, 12 and 13 show a variety of variations employing the releasable engagement system described with reference to FIGS. 9*a* and 9*b*.
Figure 10B:
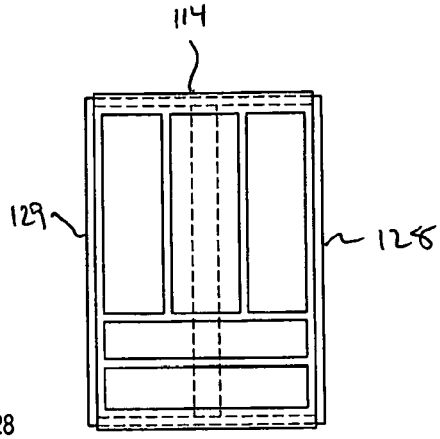
Figure 10C:
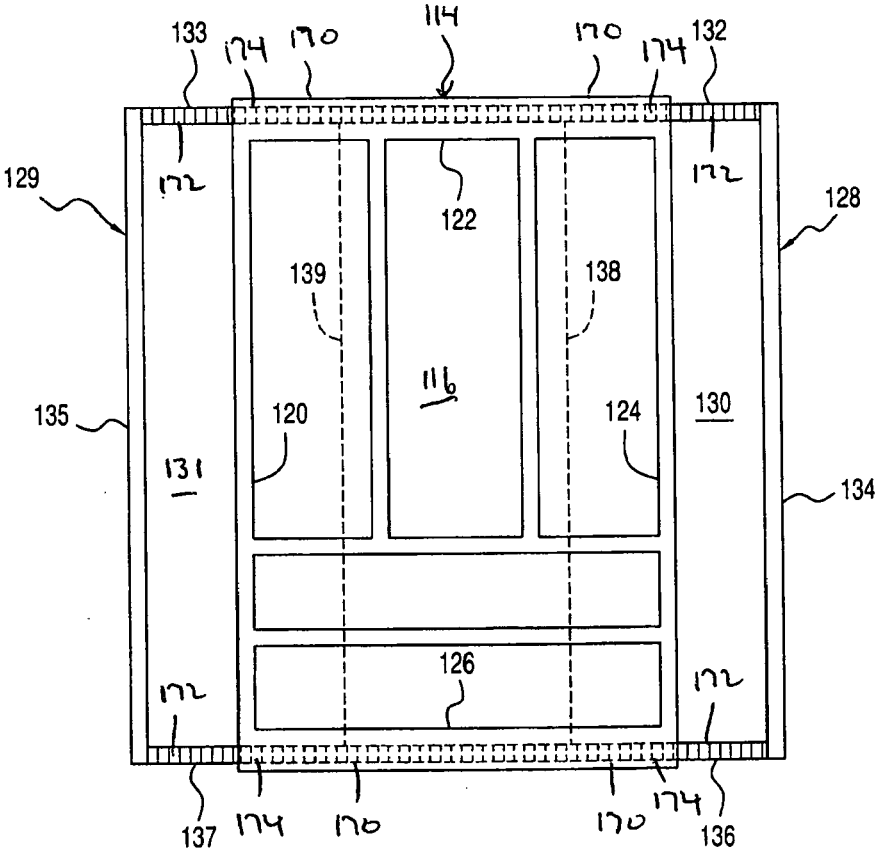

Implementation of the serrated edge design discussed above is shown with reference to the various embodiments disclosed in FIGS. 10*a*, 10*b*, 10*c*, 11, 12 and 13. With reference to FIGS. 10*a*, 10*b*, and 10*c*, a three-part design is disclosed. The three-part design includes a first element, a first second element and a second second element 114, 128, 129. This design allows for lateral adjustment of the first, first second and second second elements 114, 128, 129 via the interaction of the serrated teeth 174 along the guide slots 170 and guide ribs 172 of the respective first, first second and second second elements 114, 128, 129.

More particularly, the first element 114 preferably has outer peripheral raised edges including four exterior edges 120, 122, 124, 126. As such, the combination of raised exterior edges 120, 122, 124, 126 complete the continuous peripheral edge surrounding the perimeter of the first element 114.

The first second element 128 also has a bottom surface 130 and three raised edges, that is, raised edges seen as exterior edge 132, exterior edge 134 and interior edge 136. The fourth edge is a flat edge 138 that is in the plane of the bottom surface 130 and, as can be seen, is adapted to be slidingly nested with the first element 114 by positioning the flat edge 138 underneath the interior edge 124 of the first element 114. Thus, the first second element 128 can be moved toward and away from the first element 114 in the length direction to vary the overall length of the organizer 112 in order to fit within the particular length of a drawer or other rectangular space where the organizer 112 is being used.

As to the second second element 129, it is substantially a mirror image of the first second element 128 and is shaped and dimensioned to fit on the opposite side of the first element 114. As such, the third element includes a bottom surface 131 and three raised edges, that is, raised edges seen as exterior edge 133, exterior edge 135 and interior edge 137. The fourth edge is a flat edge 139 that is in the plane of the bottom surface 131 and, as can be seen, is adapted to be slidingly nested with the first element 114 by positioning the flat edge 139 underneath the interior edge 124 of the first element 114. Thus, the second second element 129 can be moved toward and away from the first element 114 in the length direction to vary the overall length of the organizer 112 in order to fit within the particular length of a drawer or other rectangular space where the organizer 112 is being used.

In order to take advantage of the serrated releasable engagement system, the edges 122, 126 of the first element 114 are formed with guide slots 170 including serrated teeth 174 as described above. Similarly, the exterior edges 132, 136 of the first second element 128 and the exterior edges 133, 137 of the second second element 129 include guide ribs 172 with serrated teeth 174 shaped and dimensioned to be received within the guide slots 170 of the first element 114.

Figure 11:
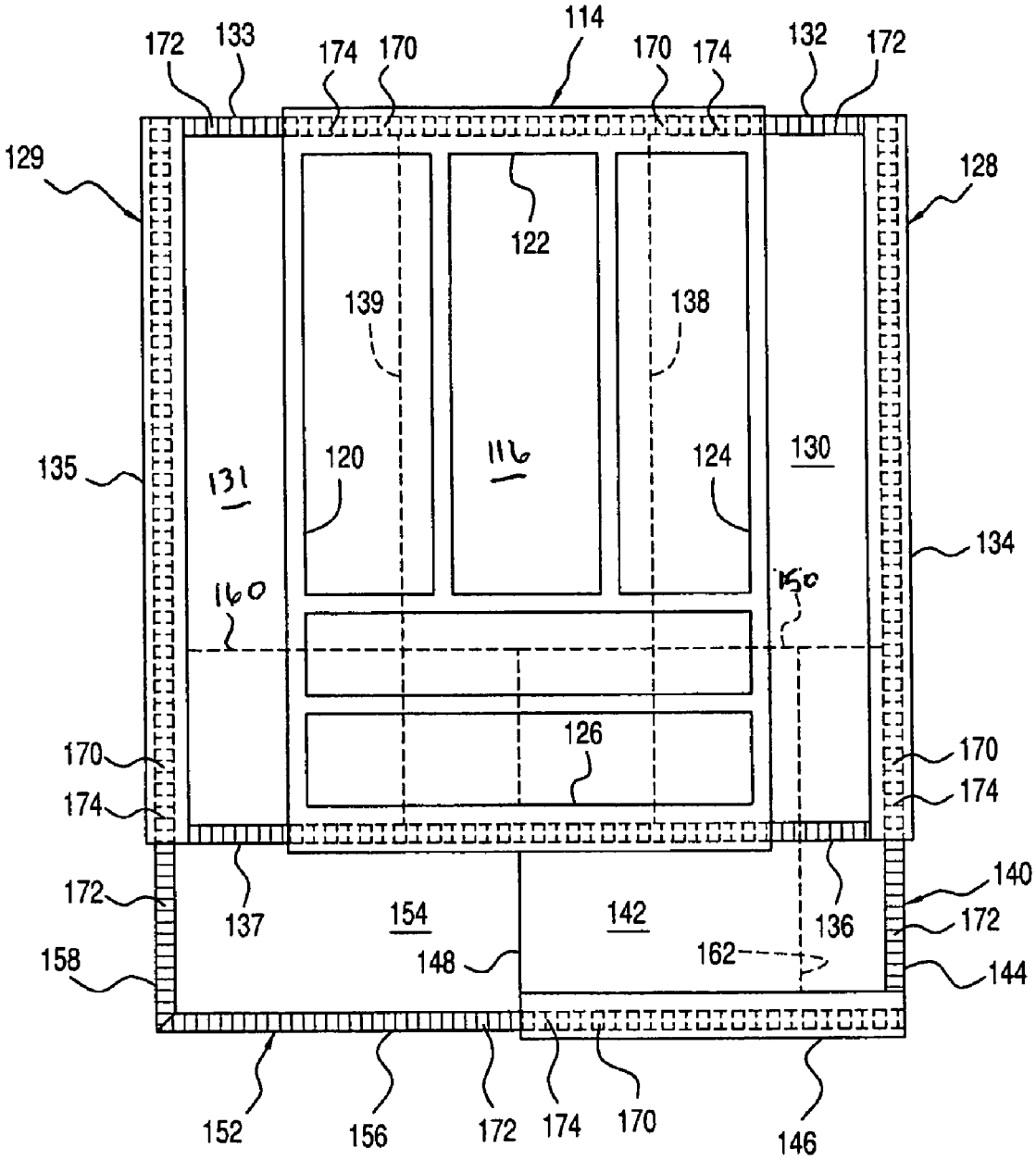

Referring to FIG. 11 a five-part system is disclosed. This variation employs additional elements allowing for adjustment in both a width direction (see FIG. 10) and a length direction. This five-part system includes the first, first second and second second elements 114, 128, 140 described above, plus third and fourth elements 140, 152 enhancing the versatility of the present system. The third element 140 includes a bottom surface 142 and having two raised edges, that is, exterior edges 144, 146 and two flat edges 148, 150. The flat edges 148, 150 are adapted to underlie the first element 114 and the first second element 128 so as to be movable in the width direction to alter the width dimension of the organizer 112. Again, the bottom surface 142 of the third element 140 thereby cooperates and nests with the bottom surfaces 116, 130, respectively, of the first and first second elements 114, 128 to maintain a complete and contiguous bottom surface of the organizer 112.

The fourth element 152 has a bottom surface 154 and raised exterior edges 156, 158 and flat edges 160, 162. As such, the flat edge 160 is adapted to underlie and nest with the first element 114 and second second element 129 so as to form a combined and contiguous bottom surface by the combined bottom surface 116 of the first element 114 and the bottom surface 154 of the fourth element 152.

The flat edge 162 of the fourth element 152 also nests with the flat surface 150 of the third element 140 and may overlie or underlie in that nesting relationship. In any event, the fourth element 152 is movable in the width direction to vary the width dimension of the organizer 112 and that width movement is undertaken in cooperation with the third element 140 to coordinate the movement such that both the third element 140 and the fourth element 152 act together when moving in the width direction to make sure the raised exterior edges 146, 156 are together and form a straight, raised exterior edge of the organizer 112.

Additionally, the third element 140 and the fourth element 152 can move in the length direction with respect to each other so as to remain aligned with the first and first second elements 114, 128 when those elements are moved to vary the length dimension.

In order to take advantage of the serrated releasable engagement system, the respective edges 134, 135 of the first second and second second elements 128, 129 are formed with guide slots 170 including serrated teeth 174 as described above. Similarly, the respective edges 144, 158 of the third and fourth elements 140, 152 include guide ribs 172 with serrated teeth 174 shaped and dimensioned to be received within the guide slots 170 of the first element 114. Similarly, the edge 146 of the third element 140 is provided with a guide slot 170 with serrated teeth 174 shaped and dimensioned for receiving a guide rib 172 formed along the edge 156 of the fourth element 152.

Figure 12:
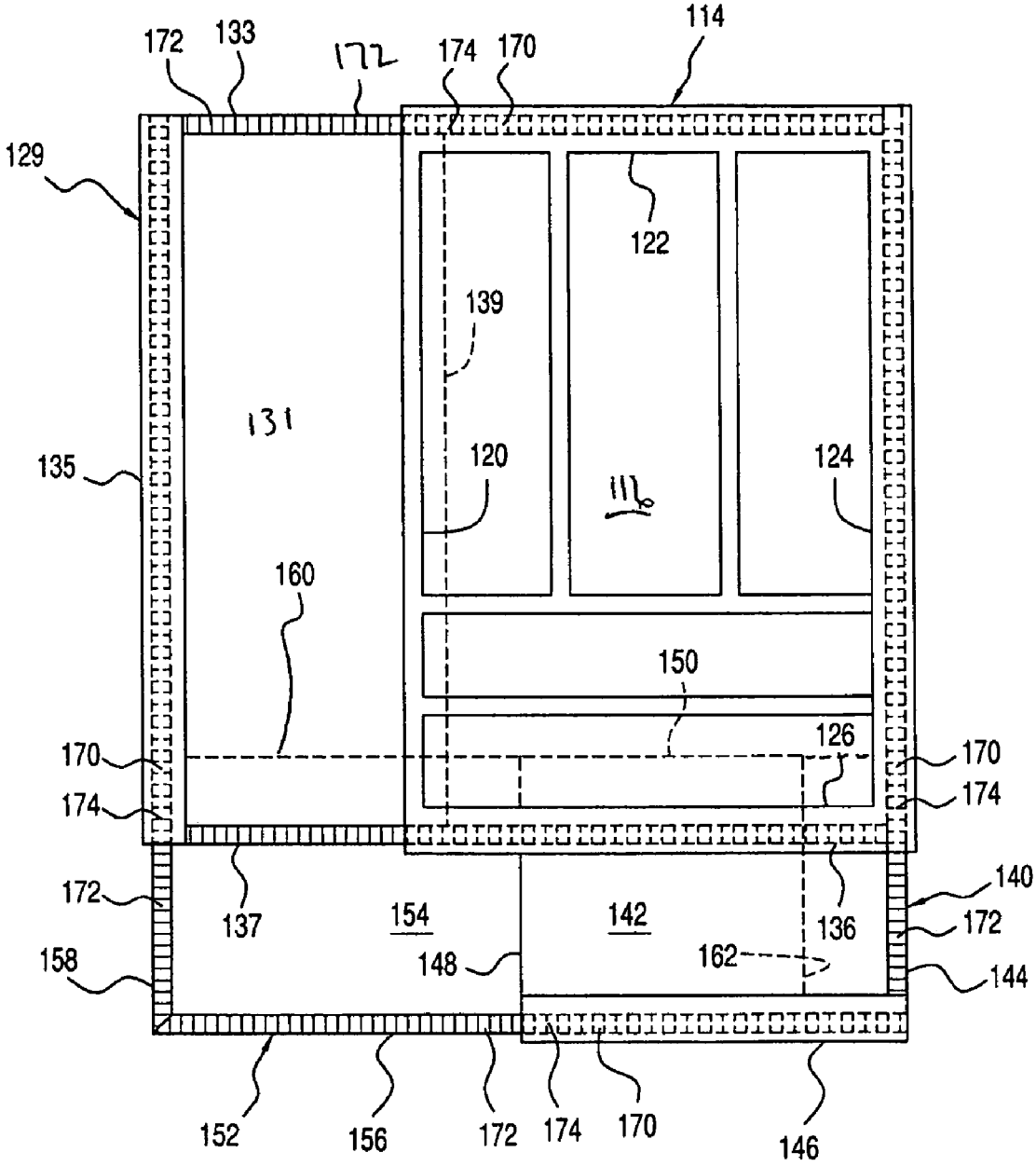

Referring to FIG. 12, a four-part variation in accordance with the present invention is disclosed, which also allows length adjustment as well as width adjustment. The variation shown in FIG. 12 employs first, second second, third and fourth elements 114, 129, 140, 152. In order to allow for interengagement with the second second element 129 the edge 120 of the first element 114 is provided with guide slots 170 shaped and dimensioned to receive the guide ribs 172 of the third and fourth elements 140, 152.

Figure 13:
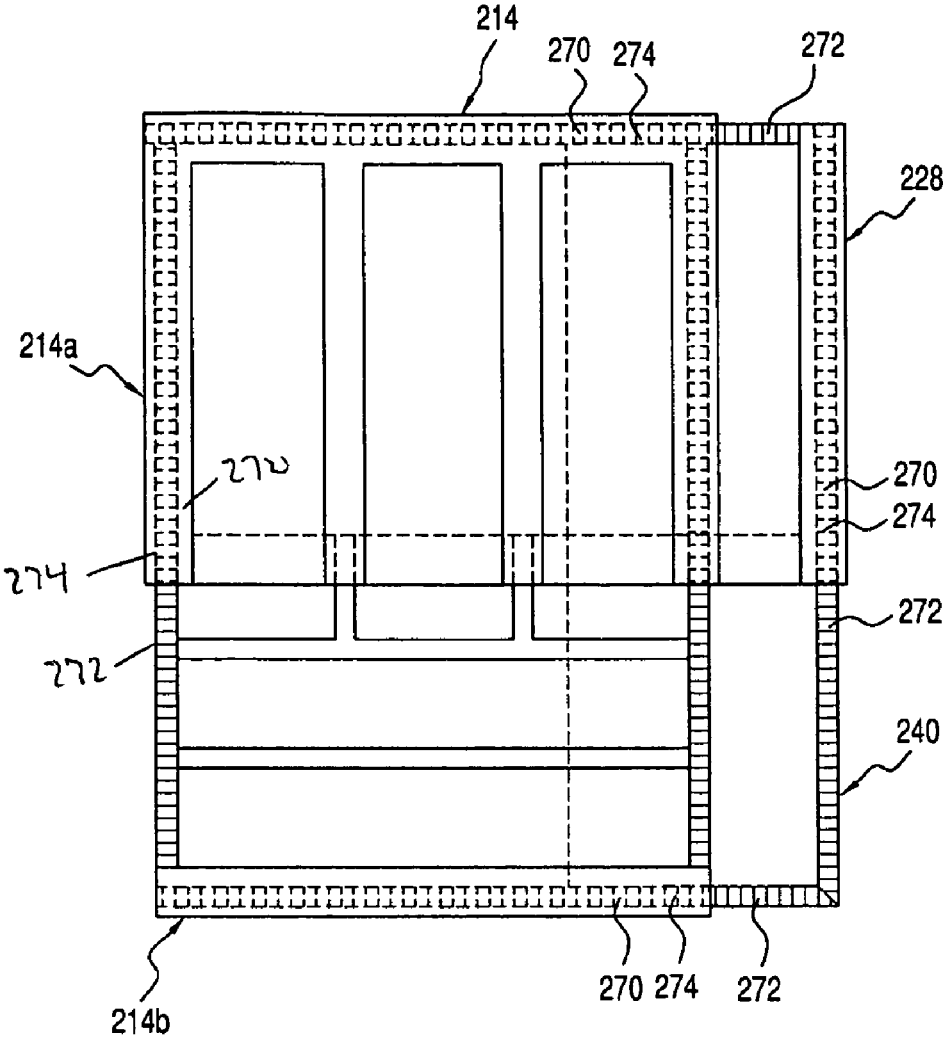

As for the embodiment shown in FIG. 13, this variation employs a split first element 214 composed of a primary first element 214a and a secondary first element 214b slidably engaged with guide rails 270 and guide slots 272 with serrated teeth 274 as disclosed above. This embodiment also employs a first second element and a third 228, 240, which are respectively linked with the first element via guide rails 270 and guide slots 272 with serrated teeth 274.

Figure 14:
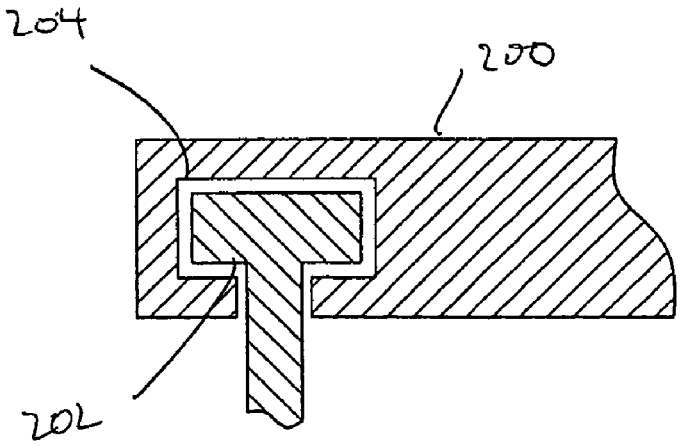
FIG. 14 is a cross-sectional view of an alternate engagement system that may be employed in accordance with the present invention.

Referring to FIG. 14, and as those skilled in the art will certainly appreciate, it is contemplated the releaseable engagement system disclosed above with reference to FIGS. 9*a*, 9*b*, 10, 11, 12, and 13, may be replaced with a rail type system 200 composed of a rail member 202 and a rail slot 204.

As those skilled in the art will appreciate, the exterior edges of the various elements of those embodiments disclosed above are provided with serrated teeth at locations desirable for achieving the interlocking arrangement contemplated in accordance with the present invention. With this in mind, the various elements making up the present organizer in accordance with the present invention may be provided with serrated teeth at a variety of points to enhance the versatility of the present organizer by allowing the elements to be assembled in various ways.

In addition, the organizer will be incrementally rigid with respect to the interlocking elements.

Those skilled in the art will readily recognize numerous adaptations and modifications which can be made to the multi-directional organizer of the present invention which will result in an improved process and device, yet all of which will fall within the scope and spirit of the present invention as defined in the following claims. Accordingly, the invention is to be limited only by the following claims and their equivalents.

The invention claimed is:

1. An expandable organizer for use within a rectangular space to fully conform to the space within the space, said organizer comprising:

a first element containing raised edges surrounding a bottom surface, the raised edges being attached, to one another so as to form a fixed continuous peripheral edge defining a fixed area there within; a plurality of substantially fixed upwardly raised dividers situated within the fixed area created by the peripheral edge, a portion of which dividers are attached to at least a portion of the peripheral edge and a portion of which dividers are attached to each other, so as to form a plurality of spaces within said fixed area, and wherein said dividers are in substantially fixed position relative to each other and relative to the peripheral edge;

at least one second element comprising three raised edges and a bottom surface and a substantially flat fourth edge that is in the plane of the bottom surface and wherein said second element is adapted to be slidingly nested with the first element so as to vary the length of the first element when the second element is moved closer to and away from the first element; and at least one third element comprising two raised edges and a bottom surface and two substantially flat edges that are in the plane of the bottom surface and wherein said third element is adapted to underlie and be slidably nested with the first and second elements so as to vary the width of the first and second elements when the third element is moved closer to and away from the first and second element; and wherein the bottom surfaces of each of the first, second and third elements form a contiguous bottom surface and the second and third elements may be moved substantially simultaneously to reduce or enlarge the width and length of the organizer the organizer further including mating serrated teeth formed along the raised edges of the respective first element, second element and third element for releasably coupling the first, second and third elements and a guide slot formed on one of said adjacent elements engaged and dimensioned to capture a guide rib formed on the other of said adjacent elements, wherein the guide slot and guide rib include said mating serrated teeth, said mating serrated teeth allow the length and width of the organizer to be adjusted by sliding between sequential, interlocked positions.

2. The organizer as defined in claim 1 wherein the rectangular space is a drawer.

3. The organizer as defined in claim 1 wherein the mating serrated teeth allow a user to adjust the dimensional relationship between the adjacent elements and yet the adjacent elements are fixed in position such that the organizer will not change dimensions on its own.

4. The organizer as defined in claim 1 wherein said at least one second element comprises two second elements and said third element is nested with only one of said two second elements.

5. The organizer as defined in claim 1 wherein said first element, at least one second element, said third element and said fourth element each have at least one raised peripheral edge, forming a continuous peripheral raised edge of the organizer.

6. The organizer as defined in claim 1 wherein said at least one second element is nested by interfitting the bottom surface of said at least one second element underneath the bottom surface of said first element.

7. The organizer as defined in claim 1 wherein said bottom surface of said fourth element is nested with said at least one second element by said bottom surface of said fourth element being slidingly located underneath the bottom surface of said at least one second element.

8. The organizer as defined in claim 1 wherein there is at least one fourth element comprising two raised edges defining a bottom surface and two substantially flat edges that are in the plane of the bottom surface, said fourth element being substantially in mirror image relationship to said third element and wherein said fourth element is adapted to underlie and sidably nest with the first element along one of its flat edges and underlie or overlie and slidably nest with the third element along the other of its flat edges, so as to vary the width of the first element when the fourth element is moved closer to and away from the first element;

wherein the bottom surfaces of each of the first, second, third and fourth elements form a contiguous bottom surface; and wherein the second, third and fourth elements may be moved substantially simultaneously to reduce or enlarge the width and length of the organizer.

9. The organizer as defined in claim 8 wherein at least two adjacent elements have raised edges that are releasably engaged with each other.

* * * * *